US007456577B2

(12) United States Patent
Vanpoperynghe et al.

(10) Patent No.: US 7,456,577 B2
(45) Date of Patent: Nov. 25, 2008

(54) MICRO-WAVE TUBE WITH MECHANICAL FREQUENCY TUNING

(75) Inventors: Jehan Vanpoperynghe, Villemomble (FR); Jean-Paul Prulhiere, Bordeaux (FR)

(73) Assignee: Commissariat a l'Energie Atomique, Paris (FR)

( * ) Notice: Subject to any disclaimer, the term of this patent is extended or adjusted under 35 U.S.C. 154(b) by 196 days.

(21) Appl. No.: 10/519,611

(22) PCT Filed: Jun. 25, 2003

(86) PCT No.: PCT/FR03/01960

§ 371 (c)(1),
(2), (4) Date: Dec. 23, 2004

(87) PCT Pub. No.: WO04/001787

PCT Pub. Date: Dec. 31, 2003

(65) Prior Publication Data

US 2006/0032446 A1 Feb. 16, 2006

(30) Foreign Application Priority Data

Jun. 25, 2002 (EP) ..... 0207849

(51) Int. Cl.
*H01J 23/213* (2006.01)

(52) U.S. Cl. ..... 315/5.47; 315/5.53

(58) Field of Classification Search ..... 315/4, 315/5, 5.46, 5.47, 5.53
See application file for complete search history.

(56) References Cited

U.S. PATENT DOCUMENTS 2,658,393 A * 11/1953 Woods ..... 74/1 R
2,853,647 A 9/1958 Litton
2,945,156 A 7/1960 Arnold et al.
3,787,748 A * 1/1974 Liepelt ..... 315/5.46
4,737,738 A * 4/1988 Perring ..... 331/82

OTHER PUBLICATIONS

International Search Report, PCT/FR03/01960, date of mailing Apr. 15, 2005.

* cited by examiner

*Primary Examiner*—Benny Lee
(74) *Attorney, Agent, or Firm*—Thelen LLP

(57) ABSTRACT

This invention relates to a microwave tube (3) for generation of an electromagnetic wave with frequency F, the tube comprises mechanical means for varying the frequency F composed of a set of rings (A, B, C, D) defining a periodic structure inside the tube and mechanical means (4, 5, 2, G) for displacing rings with respect to each other while maintaining a periodicity for periodic structure during displacement of the rings.

2 Claims, 6 Drawing Sheets

MICRO-WAVE TUBE WITH MECHANICAL FREQUENCY TUNING

CROSS-REFERENCE TO RELATED APPLICATION

This application claims priority based on International Patent Application No. PCT/FR03/01960, entitled "Microwave Tube With Mechanical Frequency Tuning" by Jehan VANPOPERYNGHE and Jean-Paul PRULHIERE, which claims priority of French Application No. 02 07849, filed on Jun. 25, 2002, which was not published in English.

TECHNICAL DOMAIN AND PRIOR ART

The invention relates to a microwave tube with mechanical frequency tuning.

The invention is used in a particularly advantageous application in the domain of electronic tubes for generating and/or amplifying radio electric signals.

The principle of a microwave tube according to known art is shown in FIG. 1. The microwave tube comprises:

- a source of electrons composed of an emission cathode K and an anode electron gun CA to form an electron beam F,
- a focusing coil L surrounding the electron beam and producing a continuous axial magnetic field B so as to prevent the electron beam expansion by mutual repulsion between electrons,
- a microwave structure H placed close to the beam and capable of generating, propagating and amplifying an electromagnetic wave, and
- a collector C to collect electrons after interaction with the wave.

Many families of tubes apply the operating principle described above, for example progressive wave tubes (PWT), BackWard Oscillators (BWO) type tubes, klystrons, magnetrons, carcinotrons, masers, etc.

These tubes can operate in single pulse mode or in recurrent mode (pulse stream).

To provide very high powers, designers use periodic structures and/or cavities that can give strong amplifications. Among these structures, there are BWO type tubes for which the schematic diagram is given in FIG. 2. A BWO type tube comprises an insert I and a periodic structure P. A distance d defines the period of the periodic structure. A BWO type microwave tube is optimised for a single frequency F. Therefore, it is only efficient within a very narrow frequency band $\Delta F$, and particularly narrow when the output power is high (typically $\Delta F/F<5\%$).

In general, the microwave tubes mentioned above are optimised to work at a fixed frequency and known means of varying the frequency of the tube always cause a severe degradation of tube performances.

The invention does not have this disadvantage.

SUMMARY OF THE INVENTION

The invention relates to a microwave tube for generation of an electromagnetic wave with frequency F, characterised in that it comprises mechanical means for varying the frequency F composed of a set of rings defining a periodic structure inside the tube, and mechanical means for displacing rings with respect to each other while maintaining a periodicity for the periodic structure during displacement of the rings.

According to a first embodiment of the invention, the mechanical means for displacing the rings comprise a set of electrical contacts between rings, at least one lead screw, a set of nuts installed on the lead screw, a set of rods, each rod firmly connecting a nut to a ring, the tube being provided with at least one slit enabling rods to pass in the wall of the tube, the lead screw comprising several sectors with different pitches capable of keeping intervals between the rings during rotation of the lead screw.

According to a second embodiment of the invention, the mechanical means for displacing rings comprise a set of electrical contacts between the rings, at least one set of pins, each pin being firmly connected to a ring, the tube being provided with at least one longitudinal slit through which pins can pass in the wall of the tube, a ring external to the tube comprising at least one set of slits, each slit in the outer ring allowing the passage of at least one pin, the slits in a set of slits having a different inclination for each ring so as to maintain a periodicity for the different rings during displacement of the rings.

Therefore advantageously, regardless of the embodiment of the invention, the mechanical means for varying the frequency F include at least one longitudinal slit formed in the tube and allowing the passage of means of entraining all rings.

According to another characteristic, the microwave tube according to the invention is a PWT, a BWO type tube, a carcinotron, or a maser.

According to yet another characteristic of the invention, the periodic structure of the microwave is corrugated plate.

The invention has the advantage that the frequency F of the emitted electromagnetic wave can be varied within a large variation range, namely a few tens of percent, while maintaining amplification performances of the electromagnetic wave existing in the power sources working at fixed frequency.

The invention is advantageously applicable to any radioelectric power source composed of a beam of electrons circulating through a structure comprising periodic or non-periodic variations.

The integrated source according to the invention comprises a periodic corrugated geometric structure to enable a frequency variation using a mechanical process enabling either a modification of the pitch of the periodic structure, for example composed of a corrugated plate, or a variation of the length of an insert, or a combination of both structures.

Advantageously, this integrated system enables fast modulation of parameters, namely the frequency and power of the radio frequency signal. The system can easily be automated and can be quickly externally controlled without needing to modify operation of the electron beam.

This integrated system can be particularly well adapted to BWO type hyper frequency tubes. It then replaces periodic structures in place and/or inserts. It is also easily adaptable to other types of tubes. It may also be associated with other systems provided to enable variation of the output frequency of the signal. It can then advantageously be used to increase the efficiency and the operating range of the system.

The frequency radiated by a tube according to the invention may advantageously be chosen in a significant range, for example several tens of percent, without reducing the output power, other tube parameters (for example such as the voltage and current of the electron beam) being unchanged.

BRIEF DESCRIPTION OF THE DRAWINGS

Other characteristics and advantages of the invention will become clearer after reading a preferred embodiment with reference to the appended figures, wherein:

FIGS. 3C-3F represent enlarged parts of FIG. 3A;

The same reference labels denote the same elements in all figures.

DETAILED DESCRIPTION OF THE PREFERRED EMBODIMENTS OF THE INVENTION

Figure 1:
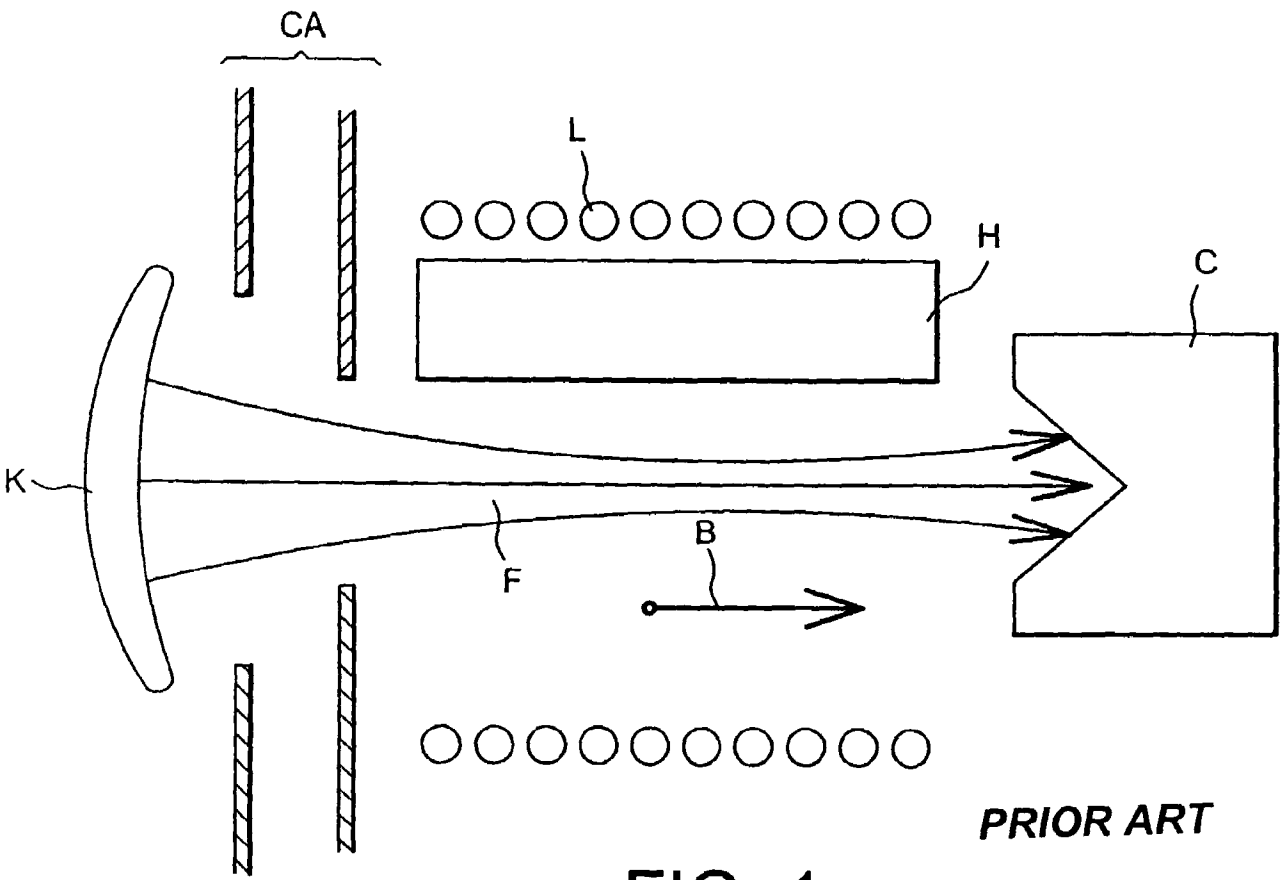
PRIOR ART FIG. 1
FIG. 1 shows a schematic diagram of the microwave tube according to known art.
Figure 2:
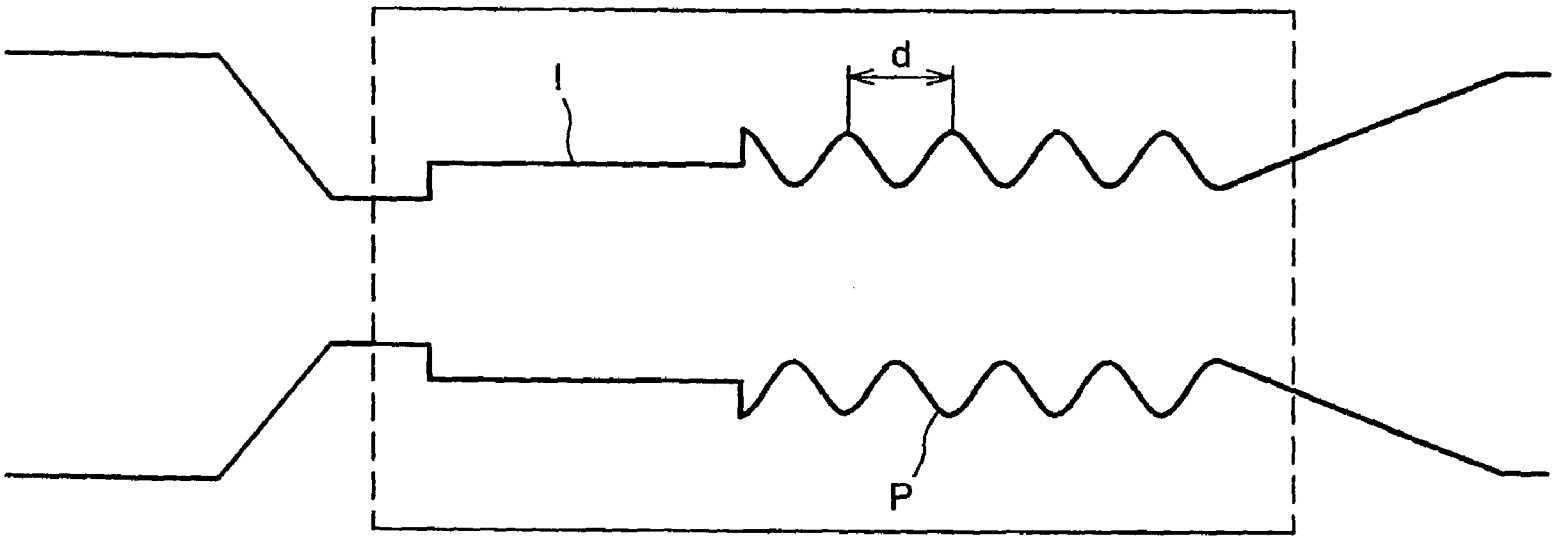
PRIOR ART FIG. 2
FIG. 2 shows a schematic diagram of the BWO tube according to known art.
Figure 3A:
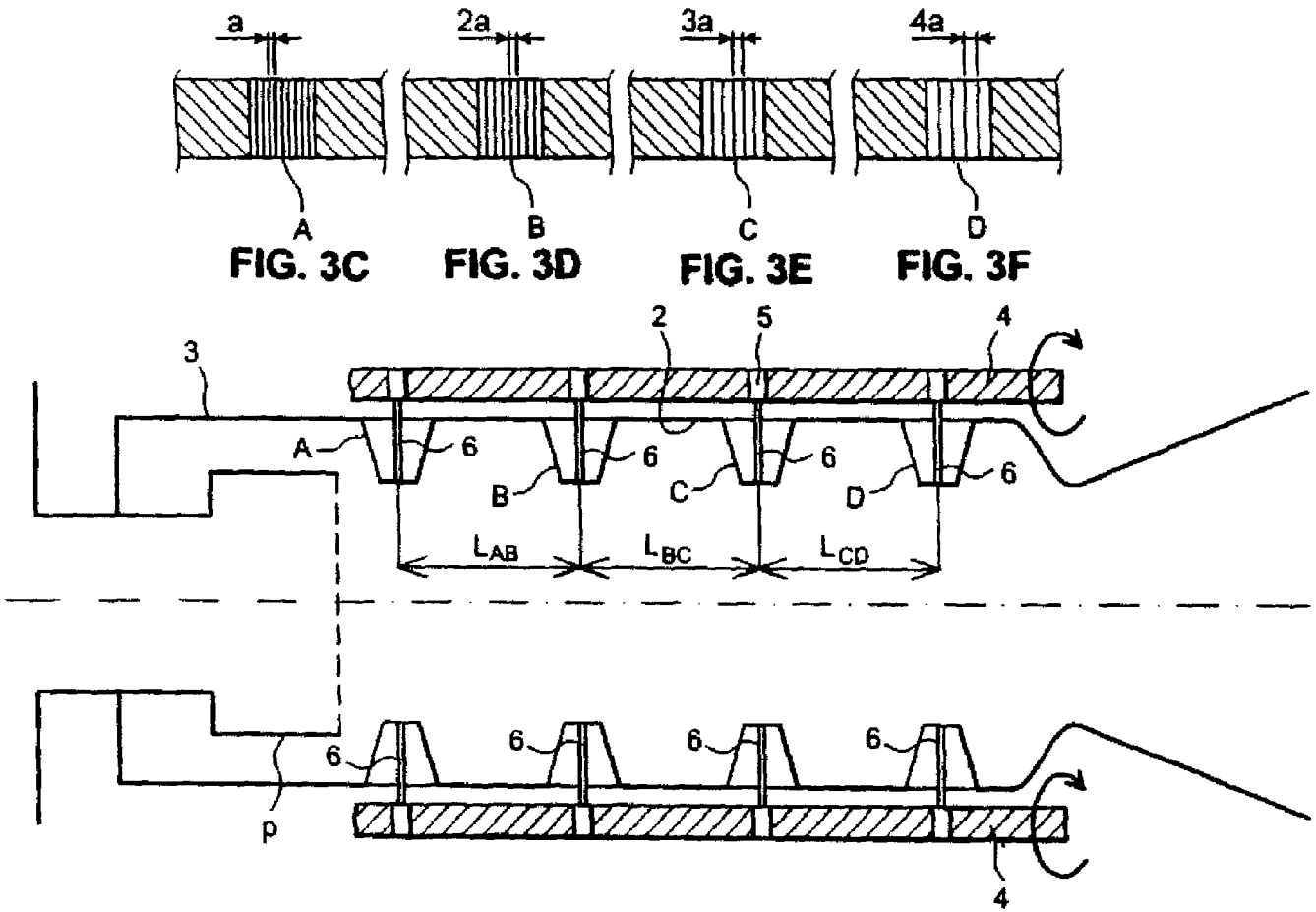
FIGS. 3A and 3B represent a first embodiment of a microwave tube according to the invention.
Figure 3B:
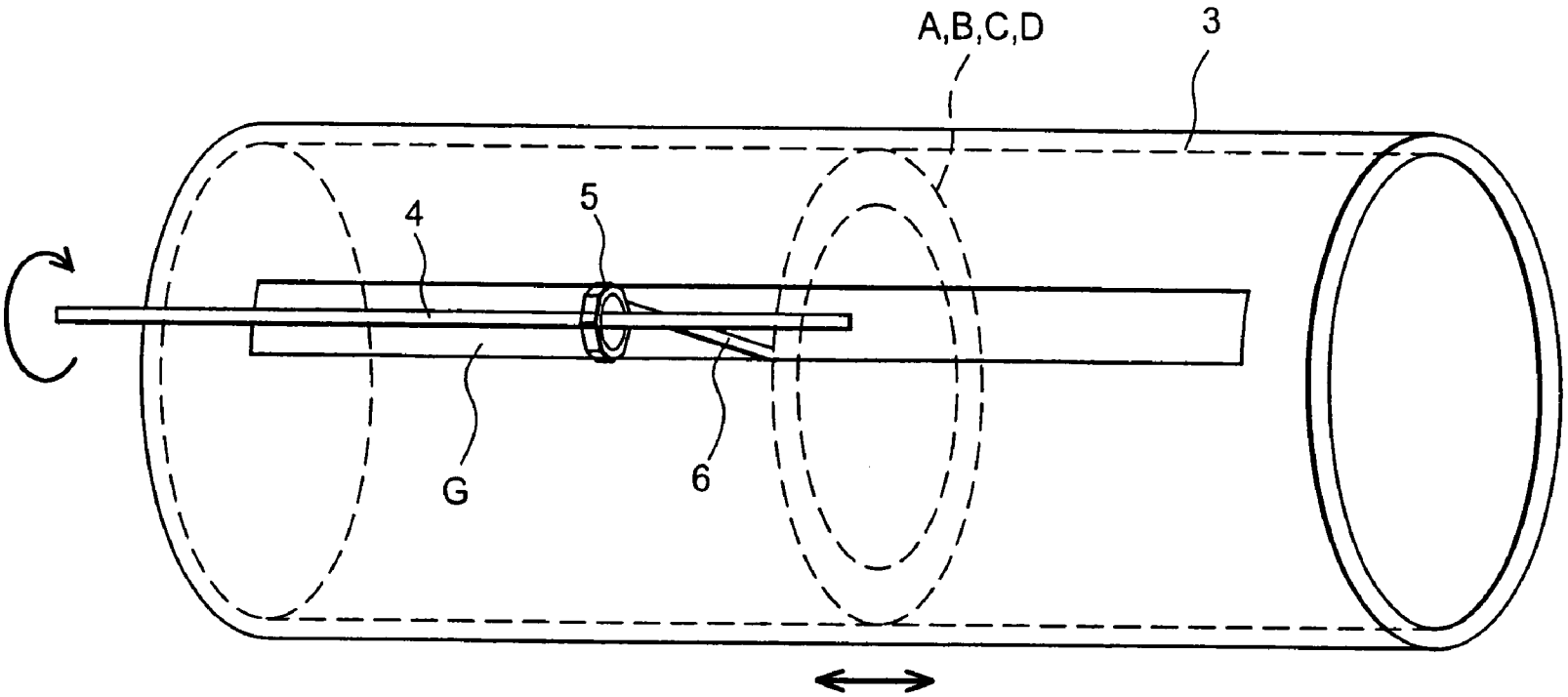

A first embodiment of the invention is shown in FIGS. 3A and 3B.

The electromagnetic structure for adjustment of the frequency of the microwave tube comprises a fixed part and a mobile part.

The fixed part is composed of the longitudinal wall 3 of the tube in which at least one guide slit G (FIG. 3B) is formed.

The mobile part comprises:

at least one lead screw 4, nuts 5 installed on the lead screw 4, a set of rods 6 and a set of rings (for example four rings A, B, C, D), each rod 6 firmly fixing a nut to a ring, the rings being installed on the inside of the wall 3 of the tube, electrical contacts 2 (FIG. 3A) between the rings.

The guide slit(s) G enable passage of rods 6 in the longitudinal wall 3 of the tube so as to connect the nuts 5 to the rings as best shown in FIG. 3B. A ring seen in section (see FIGS. 3A, 3B) may for example be profiled like a rim.

During the frequency adjustment, the lead screw is moved in rotation, which drives the nuts 5, the rods 6, the rings A, B, C, D and the electrical contacts 2 in a translation movement. According to one variant of the first embodiment, the ring A may be connected to a mechanical part p (FIG. 3A) that can then slide along tube 3.

The lead screw 4 is single piece. It is composed of several ranges of different threads adapted to each nut 5. A single lead screw is theoretically sufficient for use of the invention. As a non-limitative example, FIG. 3A illustrates the case in which the device comprises two lead screws. The second screw, when it is used, must then turn in perfect synchronism with the first lead screw. The quality of translation of the rings is improved due to symmetry of the movement application points.

A lead screw comprises several sectors with different pitches to maintain the system at the same distance between the vertices of the periodic corrugated structure formed by the rings, during rotation of the lead screw.

Let L(AB) be the distance between the rings A and B, L(BC) be the distance between the rings B and C and L(CD) be the distance between the rings C and D as best shown in FIG. 3A.

Let (a) be the pitch of the nut fixed to ring A as best shown in FIG. 3C, (2*a*) be the pitch of the nut fixed to ring B as best shown in FIG. 3D,(3*a*) be the pitch of the nut fixed to rim as best shown in FIG. 3E, (4*a*) be the pitch of the nut fixed to ring D as best shown in FIG. 3F.

When the lead screw turns by 180°, ring A moves by (3.1416)×(a), ring B moves by (3.1416)×(2a), ring C moves by (3.1416)×(3a), and ring D moves by (3.1416)×(4a). The result is:

$$L(AB)=(3.1416)(2a-a)=(3.1416)a,$$

$$L(BC)=(3.1416)(3a-2a)=(3.1416)a,$$

$$L(CD)=(3.1416)(4a-3a)=(3.1416)a.$$

Consequently:

$$L(AB)=L(BC)=L(CD)=(3.1416)a,$$

the periodicity of the structure is maintained. It varies linearly as a function of the screw rotation.

Figure 4A:
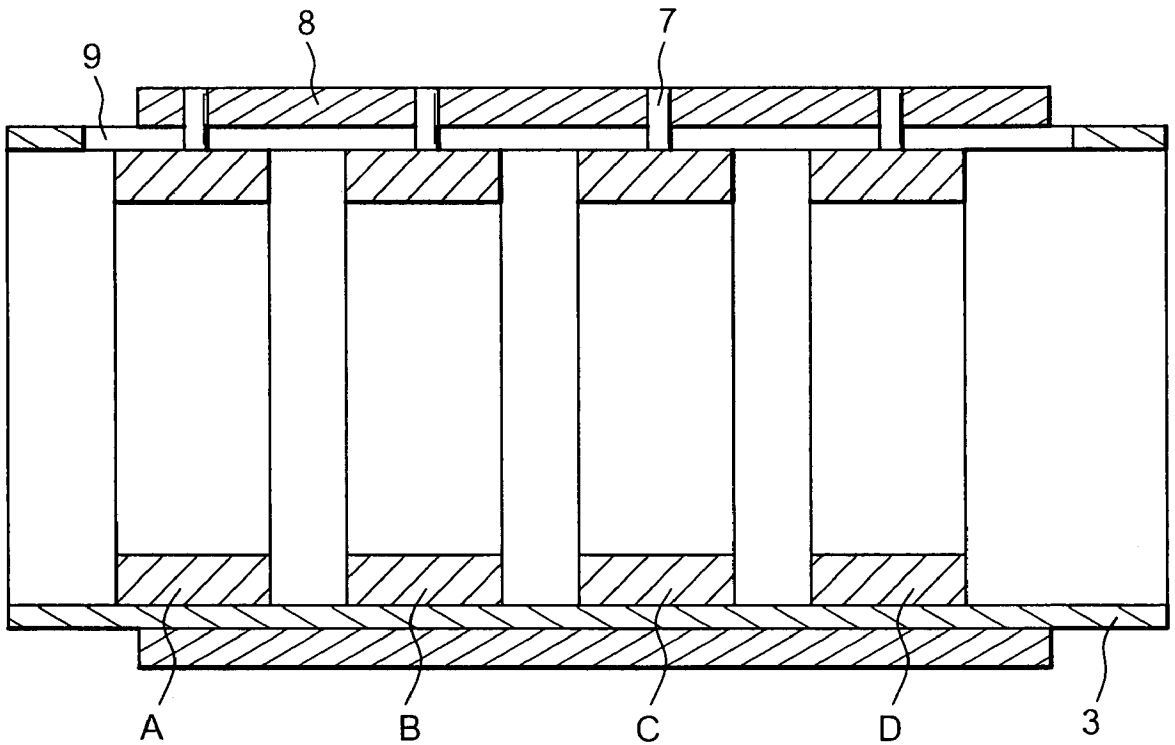
FIGS. 4A and 4B represent a second embodiment of the microwave tube according to the invention.
Figure 4B:
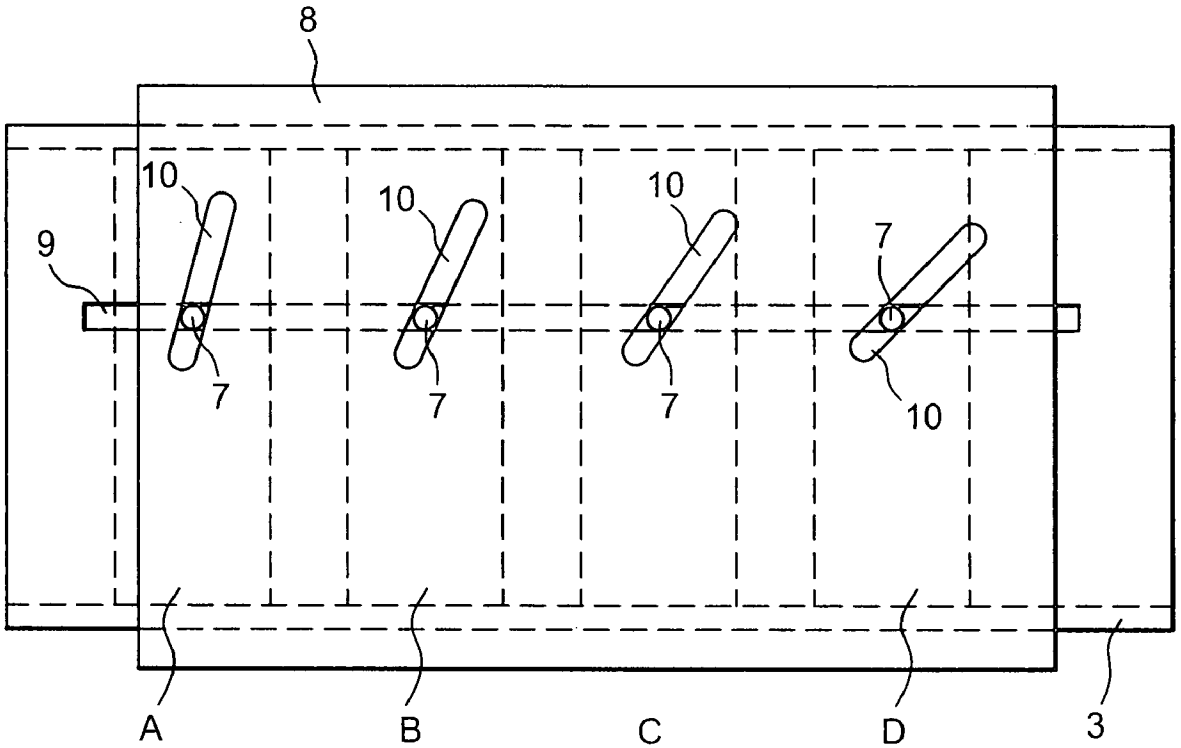

FIGS. 4A and 4B show a second embodiment of the invention.

According to the second embodiment of the invention, the variation of the periodicity of the rings is based on the rotation of a ring equipped with slits inside which pins connected to periodic corrugated structures are able to move. The inclination of these slits is such that it enables a specific interval to be maintained.

The tube 3 is the same as the tube in the previous assembly. Each ring A, B, C, D placed inside the tube 3 is fixed to a pin 7. A pin 7 moves inside two slits located on two independent parts, namely the fixed tube 3 and an outer ring 8. A first slit 9 placed on the fixed tube 3 only enables ring translation movements in the longitudinal direction of the tube. A set of slits 10 placed on the outer ring 8 fixes the range of variations of the period of the periodic structure. They correspond to the different pitches of the lead screw 4 of the previous assembly and perform the same function. The slits 10 (FIG. 4B) have a different inclination for each ring so as to keep a specific periodicity at the different rings, during displacement of the rings.

On the outer ring 8, there are as many pairs of slits 9, 10 and pins 7 as the number of rings to be moved inside the tube 3.

Therefore, in this case the outer ring 8 may be compared with a set of lead screw/nut pairs in the device according to the first embodiment of the invention.

According to the embodiment shown in FIGS. 4A and 4B, the tube 3 only comprises a single longitudinal slit 9 and the outer ring 8 only comprises a single set of slits 10. The invention also relates to the case in which the tube 3 comprises for example, two longitudinal slits 9, the two longitudinal slits then being arranged symmetrically on the tube 3, and in which the outer ring then comprises two sets of slits 10, the second set of slits 10 being associated with the second longitudinal slit to displace the rings according to the principle of the invention.

Regardless of its embodiment, the mechanism according to the invention can be automated and controlled quickly from outside and at will without modifying operation of the electron beam.

The two embodiments described above are given simply as examples. Any mechanical system that can quickly vary the position of the rings inside the tube while maintaining the periodicity of the rings may also be suitable.

The two embodiments of the invention described above can easily be coupled to stepping motors, or to jacks placed either inside the tube or outside the tube (movements then being made through sealed passages). The system according to the invention may be adapted to several source categories, without affecting the basic principle.

According to one improvement of the invention, the microwave tube may also comprise an insert with an adjustable length. This type of adjustment is implemented by displacement of a second tube in tube 3, keeping electrical continuity. This improvement is not used in itself to vary the frequency of the tube. For example, it can be used to adapt the total length of the tube (insert+periodic structure) to variations in the length of the periodic structure.

The invention claimed is:

1. A microwave tube for generation of an electromagnetic wave with frequency F, the microwave tube comprising:

mechanical means for varying the frequency F, wherein said mechanical means are composed of:

a set of rings defining a periodic structure inside the tube; and mechanical means for displacing said set of rings with respect to each other while maintaining a periodicity for the periodic structure during displacement of the set of rings, wherein the mechanical means for displacing the set of rings comprises:

a set of electrical contacts between the set of rings; and one set of pins, each pin of said one set of pins respectively being firmly connected to a corresponding ring of the set of rings, the tube being provided with at least one longitudinal slit through which each one of the pins of the one set of pins can pass in the wall of the tube, an outer ring external to the tube comprising a set of slits, each slit in the outer ring allowing the passage of a corresponding pin of the one set of pins, each slit in the set of slits having a different inclination for each corresponding ring of the set of rings so as to maintain a periodicity for the different rings of the set of rings during displacement of the set of rings.

2. A microwave tube for generation of an electromagnetic wave with frequency F, the microwave tube comprising:

mechanical means for varying the frequency F, wherein said mechanical means are composed of:

a set of rings defining a periodic structure inside the tube; and mechanical means for displacing said set of rings with respect to each other while maintaining a periodicity for the periodic structure during displacement of the set of rings, wherein the mechanical means for displacing the set of rings comprises:

a set of electrical contacts between the set of rings;

at least one lead screw;

a set of nuts installed on the at least one lead screw; and a set of rods, each rod firmly connecting a respective one of the set of nuts to a corresponding one of the set of rings, the tube being provided with at least one slit enabling the set of rods to pass in the wall of the tube, the at least one lead screw comprising several sectors with different pitches capable of keeping intervals between the set of rings during rotation of the at least one lead screw.

* * * * *